United States Patent [19]

Deshais et al.

[11] 4,168,789

[45] Sep. 25, 1979

[54] METERING APPARATUS FOR MOLTEN METAL

[75] Inventors: Richard Deshais, Paris; Pierre Vaury, Clamart, both of France

[73] Assignee: Novatome Industries, Le Plessis Robinson, France

[21] Appl. No.: 841,530

[22] Filed: Oct. 11, 1977

[30] Foreign Application Priority Data

Oct. 25, 1976 [FR] France ..... 76 32088

[51] Int. Cl.[2] ..... B22D 39/00

[52] U.S. Cl. ..... 222/594; 164/154; 164/316; 222/64

[58] Field of Search ..... 164/154, 155, 312, 316, 164/317; 222/590, 591, 594, 595, 64, 383, 255

[56] References Cited

U.S. PATENT DOCUMENTS

| | | | |
|---|---|---|---|
| 3,201,836 | 8/1965 | Nyselius | 164/312 |
| 3,396,870 | 8/1968 | Diamond et al. | 164/155 UX |
| 3,504,825 | 4/1970 | Diamond et al. | 222/595 X |
| 3,834,587 | 9/1974 | Bengt et al. | 222/595 |
| 4,030,538 | 6/1977 | Carbonnel | 164/155 X |
| 4,061,176 | 12/1977 | Carbonnel | 164/312 X |

*Primary Examiner*—David A. Scherbel

*Attorney, Agent, or Firm*—Haseltine, Lake & Waters

[57] ABSTRACT

In the feeding of molten metal from a container therefor, e.g., a storage basin, a furnace or a crucible, to a chamber, e.g., an injection cylinder or a dispensing chamber, having an electromagnetic pump partially immersed in the container, the outlet of the pump being connected by a feedline to the chamber, the molten metal is metered by apparatus comprising a detachable ascending control pipeline connected to the feed pipeline, an electromagnetic presence detector arranged to detect molten metal in the control pipeline at the level of the filling height of the chamber, and a progressive voltage generator connected in series with the electrical circuit of the pump and including a starter circuit and a stop circuit to which the presence detector is connected.

7 Claims, 5 Drawing Figures

U
U1
U0
U
O
t
t1
t2
t'3
t3
ΔU'
V
ΔH
40
41
42
43
44
45
46
47
H2
H1
Ho
h
6'
32
5
1
14
10
9
8
2
3

METERING APPARATUS FOR MOLTEN METAL

FIELD OF THE INVENTION

The present invention relates to apparatus for metering molten metal fed to a chamber, e.g., an injection cylinder or to a dispensing chamber for the purpose of casting the metal. This feeding is effected by means of an electromagnetic pump which takes the molten metal from a container, e.g., a storage basin, a furnace or a crucible.

PRIOR ART

Pressure casting installations are known which include apparatus for metering the molten metal fed to an injection cylinder, which apparatus stops the pumping of the molten metal into the injection cylinder when the metal reaches a predetermined level. In the most highly developed installations, the pumping of the molten metal taken from the storage basin, is effected by means of an electromagnetic pump which is partially immersed in the molten metal. In order to ensure that the junction between the rising pipeline issuing from the pump and the injection cylinder is leakproof, this junction must be held rigidly. As a result, the pump must be fixed relative to the injection cylinder. It is thus necessary to fix the pump to the storage basin. However, the level of the molten metal in this basin will necessarily vary, and consequently the pump lift height to be provided will vary. In the currently known apparatus, the constancy of level in the injection cylinder is ensured by means of a level-maintaining basin fed through a pipeline connected as a branch pipeline to the pumping pipeline. In this basin, the level of the molten metal is controlled with great precision by the threshold height of an overflow. It is important to note that the voltage applied to the pump must be adjusted so that when the molten metal is at its lowest level in the storage basin, the pump lift height reaches the threshold of the overflow and exceeds it slightly. It will thus be seen that if the molten metal is at its maximum level in the storage basin, the pump will continue to deliver when the predetermined level in the injection cylinder is reached. Accordingly, a considerable amount of molten metal overflows from the overflow of the level-maintaining basin, becomes mixed with air, oxidizes, if an easily oxidizable metal such as aluminum is concerned, and forms a particularly objectionable thick froth on the surface of the bath of molten metal contained in the storage basin. Furthermore, the molten metal which overflows is needlessly cooled and creates a flow of colder metal into the storage basin, which is detrimental to the homogeneity of the metal subsequently injected into the mould.

Consideration has been given to replacing the level-maintaining basin by a presence-detecting device. Such a device, which is already known, comprises a very short length of refractory pipeline and a closed magnetic circuit comprising two branches. The first branch is surrounded by a coil through which passes an alternating current which gives rise to an alternating magnetic field in the magnetic circuit, and the second branch passes through the said refractory pipeline in an envelope of refractory material. When the molten metal reaches the level of the second branch of the magnetic circuit a short-circuit loop is formed in the molten metal. An intense current is generated which results in an abrupt variation in the current fed to the coil. It is this surge in current which is used as a signal for detecting the presence of the molten metal at this level. However, such a signal is entirely useless if, as is the case with regulation by means of a level-maintaining basin, there is permanently applied to the pump a voltage equal to the voltage required to cause the molten metal to rise to the predetermined height from its lowest point in the storage furnace. Accordingly, it will be clear to those skilled in the art that a presence-detecting device alone is inadequate for ensuring stability of metering of the amount of metal to be injected from a level which changes constantly.

SUMMARY OF THE INVENTION

According to the present invention, there is provided apparatus for metering molten metal fed to a chamber through a feed pipeline connected to the outlet of an electromagnetic pump, at least partially immersed in a container for molten metal, said apparatus comprising:

a detachable ascending control pipeline connected to said feed pipeline;

at least one electromagnetic presence detector; and a progressive voltage generator connected in series with the electrical circuit of said electromagnetic pump and including a starting circuit and a stop circuit;

wherein said presence detector is arranged to detect molten metal in said control pipeline at the level of the filling height of said chamber and is connected electrically to said stop circuit of said progressive voltage generator.

The metering apparatus may comprise a second electromagnetic presence detector for detecting molten metal in said control pipeline at the level of the inlet of said chamber, said second presence detector being connected to said starting circuit of said progressive voltage generator, either directly or via a delay relay.

Said control pipeline may include a safety overflow pipeline for returning excess molten metal to said container, but the inlet to said overflow pipeline is located well above said first presence detector and only serves as a safety system, so that in normal operation neither bubbling nor froth occurs at the surface of the molten metal contained in said container.

Operation of the apparatus can thus be controlled entirely by electrical signals and can therefore be automated directly.

BRIEF DESCRIPTION OF THE DRAWINGS

The invention will be more fully understood from the following description of embodiments thereof, given by way of example only, with reference to the accompanying drawings.

In the drawings.

DETAILED DESCRIPTION

Figure 1:
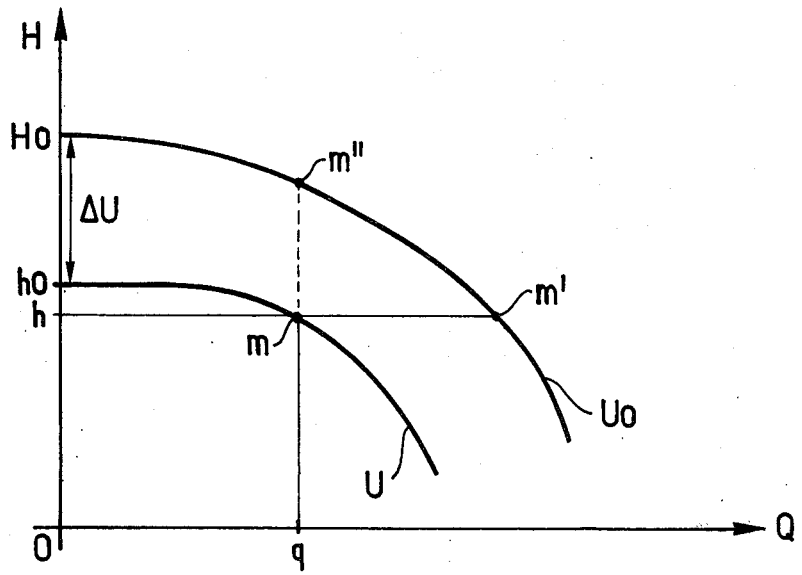
FIG. 1 graphically shows the conventional diagram (H)Q of an electromagnetic pump which gives the lift height H as a function of the delivery rate Q of the pump for various values of the voltage U applied to the pump.

FIG. 1 graphically shows a diagram of the lift height H of an electromagnetic pump, in a rising pipeline, as a function of the delivery rate Q for various values of the voltage U applied to the pump.

A point m on this diagram corresponds to a lift height h in the rising pipeline and to a delivery rate q of the electromagnetic pump.

If the voltage applied is kept constant, the point m will describe the curve U=constant, along which the lift height h in the pipeline will increase and tend towards its maximum value ho, the delivery rate decreasing to zero.

Starting from the point ho, the voltage U applied to the pump can be increased slightly by a value ΔU, and the lift height in the rising pipeline can be brought to the value Ho located on the curve:

$$Uo = U + \Delta U = \text{constant}$$

while the delivery rate is substantially zero.

It is also possible to reach the point Ho as follows: starting from the point m, corresponding to the delivery rate q and to the lift height h located on the curve U=constant, the increase in voltage ΔU can be applied abruptly to the pump. The figurative point becomes m′ on the curve Uo=constant. Keeping the voltage constant now, the delivery rate is allowed to decrease to zero and at the same time the lift height will tend to increase to the value Ho.

It is also possible to apply the increase in voltage ΔU while maintaining the delivery rate constant and equal to q; the figurative point then becomes m″ and from there, if the voltage is kept equal to Uo, the figurative point will again tend towards Ho. It is thus seen that regardless of the values q and h and of the voltage U applied to the electromagnetic pump, it is always possible to achieve a lift height Ho which is fixed relative to the pump at a point of zero delivery rate located on a curve Uo=constant, by causing the actual voltage applied to the pump to undergo a variation ΔU, provided however that the value Ho is less than or at most equal to the maximum lift height of the pump.

In the storage furnace, the level of the molten metal will constantly vary relative to the position of the pump, because the pump is fixed. Thus, on applying to the pump a voltage U, a lift height h will result which varies with the level of the molten metal in the storage furnace. However, it has just been seen that starting from these given values, it is possible to bring the figurative point m to a point Ho which is fixed relative to the pump.

Figure 2:
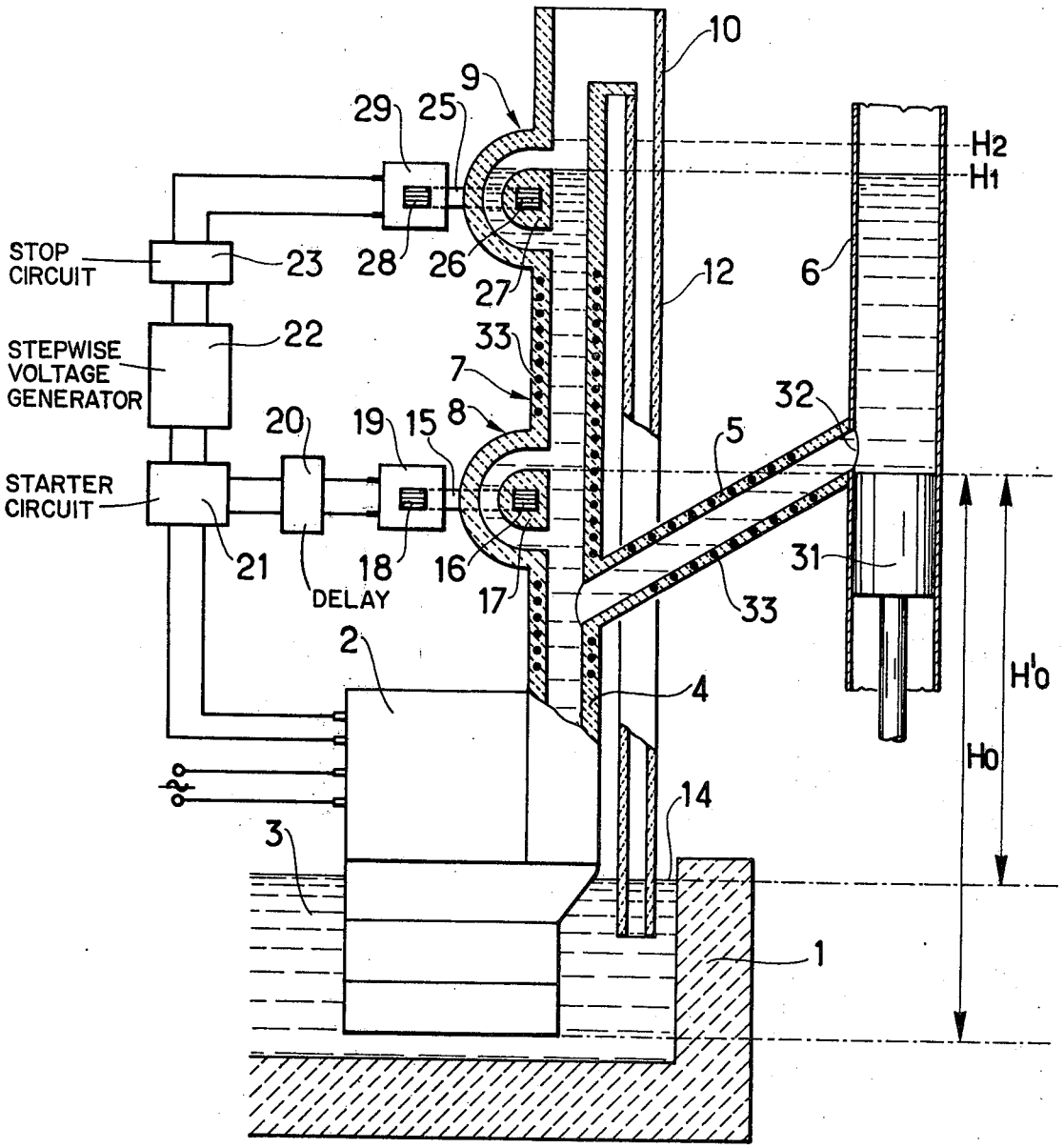
FIG. 2 schematically represents an embodiment of an apparatus for metering molten metal introduced into an injection cylinder.

FIG. 2 shows an embodiment of apparatus for metering molten metal according to the invention installed in a known pressure casting apparatus in which the molten metal is introduced into a cylindrical vessel 6 called the "injection cylinder," from which molten metal is fed in a known manner into the mould (which is not shown) by means of a hydraulically controlled piston 31 (the controls not being shown). The metering apparatus to be described makes it possible to determine with precision the amount of metal introduced into the injection cylinder. This injection cylinder 6 can be horizontal or vertical or, if desired, inclined. In FIG. 2, the cylinder has been shown vertical solely for reasons of convenience of illustration.

FIG. 2 shows the auxiliary basin 1 of a melting furnace. This basin can be replaced by a storage basin or a crucible without departing from the general nature of the description. An electromagnetic pump 2 is partially immersed in the molten metal 3. This electromagnetic pump is fixed relative to the basin from which the metal is taken. The outlet pipeline 4 of the pump is divided into a rising feed pipeline 5 connected to the injection cylinder 6 and into a control pipeline 7 which is vertical in the present Figure but which can be inclined if the circumstances and the installation so require.

The control pipeline 7 is detachable and comprises a lower electromagnetic presence detector 8 and an upper electromagnetic presence detector 9. The pipeline 7 extends upwards to a level slightly below the maximum lift height (at zero delivery rate) of the pump, so as to form a safety or overflow chamber 10 provided with a safety or overflow channel 12 leading to the basin 1 and ending below the level 14 of the molten metal 3 in the basin 1.

A progressive voltage generator is connected in series to the electrical circuit of the pump 2 and the output of the generator is added to the voltage Uo already applied to the pump. The generator employed in the present example is a stepwise voltage generator 22.

The lower presence detector 8 comprises a closed magnetic circuit 15 of which one branch 16 passes through the control pipeline 7 in a sleeve of refractory material 17. The other branch 18 is surrounded by a coil 19. The coil is fed with alternating current and is furthermore connected to the starter circuit 21 of the stepwise voltage generator 22, if appropriate via a delay element 20.

The upper presence detector 9 also comprises a closed magnetic circuit 25, of which one branch 26 passes through the control pipeline 7 in a sleeve of refractory material 27, the other branch 28 being surrounded by a coil 29 fed with alternating current and additionally connected to the stop circuit 23 of the stepwise voltage generator 22.

Figure 3:
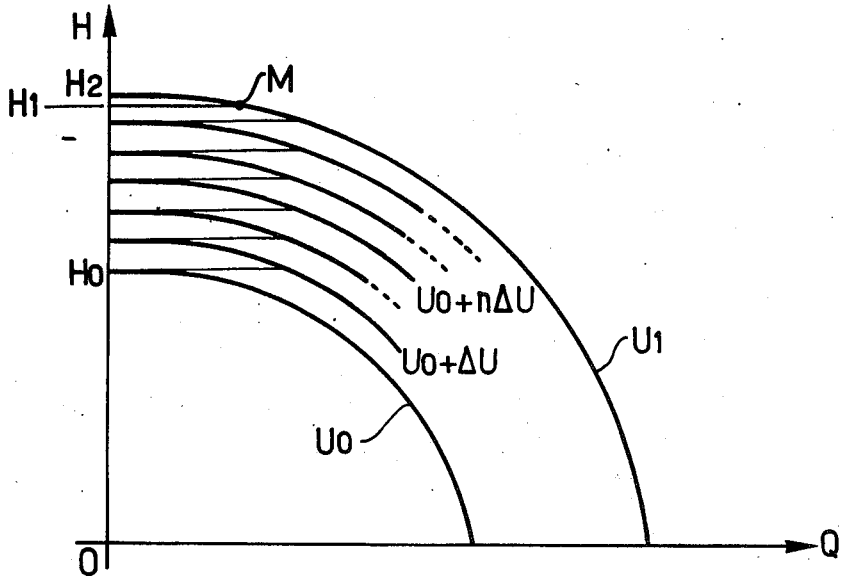
FIG. 3 graphically shows the rise in voltage produced by means of a stepwise voltage generator.

The mode of operation of the apparatus will be clear by referring to FIG. 2 and to the diagram of FIG. 3.

It will first be assumed that the control pipeline 7 is filled to the level Ho, fixed relative to the pump. The delivery rate is zero and the point Ho is on the axis OH and corresponds to a voltage Uo. The piston 31 of the injection cylinder 6 is in the low position as shown in FIG. 2. In order to fill the injection cylinder, the level of the metal must be raised to the height H1. The voltage generator 22 is started, for example, by means of the lower presence detector 8. Generator 22 generates a sequence of voltage increases ΔU which lead the figurative point to the point M (FIG. 3) located on the curve U1=constant. At the instant at which the stop signal is produced by the upper presence detector 9, the voltage generator 22 ceases to produce an increasing voltage and the voltage settles at the value U1, so that the figurative point moves along the curve U1=constant, to H2 which is slightly above H1. The level of the molten metal settles at H2. Accordingly, a height of metal defined with great precision by the difference in the readings H2−Ho is injected, because these two readings are fixed relative to the pump.

It is of course possible to utilize the signal of the upper detector in order to start the piston 31 immediately when the level H1 is reached. However, experience to date shows that the level reached at this instant in the injection cylinder is not perfectly defined, at least if the cycle speed of the apparatus is rather rapid, and it is preferable to take the stabilized level H2 as the reference mark.

It is even advantageous to have the possibility of adding to U1 a voltage step ΔU, if necessary, by controlling a generator adjustment button, which makes it possible to increase the length of the column of metal to be injected very slightly.

The apparatus has been described for the case where the voltage superposed on the voltage Uo is a voltage produced by a stepwise voltage generator whose amplitude and frequency can be regulated. This voltage can alternatively be obtained by means of a rotary potentiometer, the rotation of which is stopped by the signal from the upper presence detector 9.

In FIG. 2, it has been assumed that the cylinder was vertical. It is often advantageous to employ a horizontal injection cylinder because in that case the mould can be positioned farther away from the storage furnace. The installation remains the same and the mode of operation is also the same. In this case, it is still more advantageous to allow the equilibration of the levels between the control pipeline and the injection cylinder to take place completely.

Finally, the injection cylinder can be replaced by a dispensing chamber intended to feed a mould through several orifices, in the case of low pressure casting.

Figures 4A, 4B:
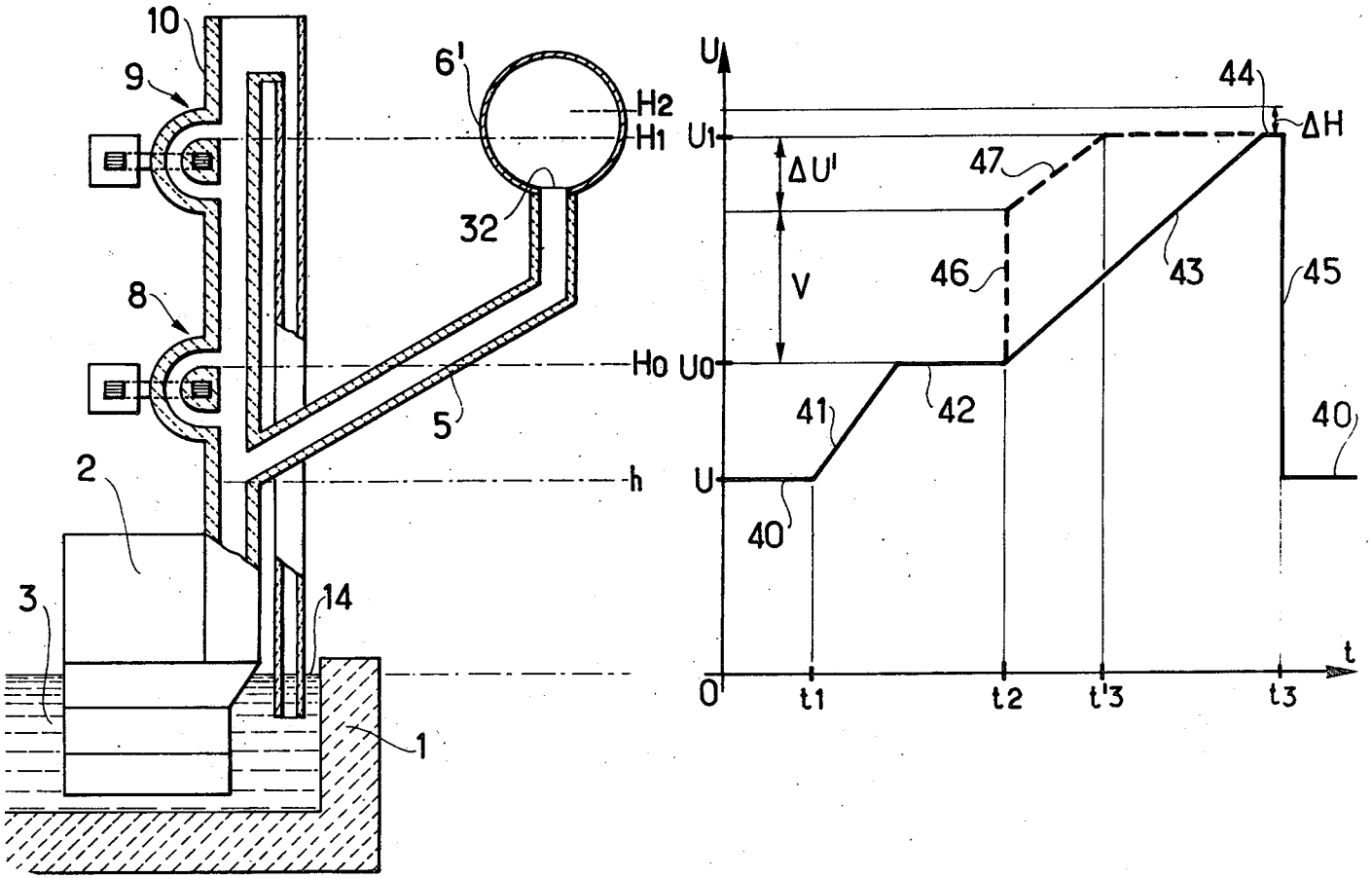
FIG. 4*a* diagrammatically illustrates an installation for metering molten metal into a horizontal injection cylinder or dispensing chamber.
FIG. 4*b* graphically shows the variation of voltage as a function of time for the installation in FIG. 4*a*.

FIG. 4 shows a diagram of the variation of the voltage applied to the pump during a cycle of operation, as a function of time. Opposite this diagram in FIG. 4*a* has been shown an injection unit equipped with a horizontal cylinder 6', and designated with the same reference numerals as in FIG. 2.

At time t=o, the voltage applied to the pump has a "base" value U corresponding to a level h which varies with the position of the level 14 of the molten metal contained in the storage furnace 1 (FIG. 2). At time t1, the device receives a pre-filling signal. A progressive voltage is superposed on the base voltage U and the voltage thus follows a path which depends on the nature of the source of the progressive voltage such as generator 22, but which in every case corresponds to an ascending slope 41. The presence detector 8 stops the increase in the voltage. It has been assumed that this rise was slow, so that when the voltage U reaches the value Uo, the level of the metal settles at Ho; this settling time can immediately follow the instant at which the level of the metal arrives at Ho.

At time t2, the device receives the filling signal. It will be assumed that filling takes place gradually in accordance with the slope 43. When the metal reaches the level H1, the increase in the voltage is stopped by the presence detector 9. If the figurative point M of FIG. 3 is near the axis OH, the filling level is substantially H1. It is possible to add a small adjustable voltage step ΔU in order to increase, if necessary, the level by ΔH for supplementary regulating.

If, at time t2, instead of applying a progressive voltage, a voltage V, which is superposed on the voltage Uo, is first applied, the delivery rate is increased, the figurative point follows the broken line 46 of the diagram of FIG. 4*b*, and filling takes place more rapidly. However, it is necessary to complete the filling over a progressive slope such as 47 in order to retain precise metering. At the instant at which the level of the molten metal has reached the level H1, the voltage is stabilized but the level of the metal continues to rise to the value H2, because the figurative point continues to follow the curve H(Q) at constant voltage U1.

At time t3, the piston 31 advances and blocks the filling orifice 32 of the injection cylinder, while the voltage of the pump is brought back to the value U. The piston then drives the molten metal contained in the injection cylinder towards the mould (which is not shown).

To ensure a constant temperature of the molten metal, the control pipeline 7 and the feed channel 5 are heated by means of a resistance 33 inserted into the walls of these two pipelines. The walls are made of a moulded refractory product, with the seats for the presence detectors moulded-in from the start.

The apparatus which has just been described has been presented in respect of its application to the metering of the contents of a pressure casting injection cylinder. The same device can feed, under similar conditions, a chamber used for low pressure casting through multiple dispensing orifices.

Finally, the device can be used with a progressive voltage generator which is superposed on a pre-existing voltage U and on the electromagnetic pump. The latter voltage can be quite close to the initial voltage Uo, as is shown by the example of the cycle of operation described with reference to FIG. 4*b*.

The metering device described above in the illustrative embodiments relating to FIGS. 3 and 4 finds extensive use in the casting of aluminum, but also finds use in the casting of any other metals.

What is claimed is:

1. Apparatus for metering molten metal fed to a chamber through a feed pipeline connected to the outlet of an electromagnetic pump at least partially immersed in a container for molten metal, the electromagnetic pump having an electrical circuit, said apparatus comprising:

an ascending control pipeline connected to said feed pipeline;

at least one electromagnetic presence detector; and a progressive voltage generator connected in series with the electrical circuit of said electromagnetic pump and including a starting circuit and a stop circuit for respectively starting and stopping the progressive voltage generator;

wherein said presence detector is arranged to detect molten metal in said control pipeline at the level of the filling height of said chamber and is connected electrically to said stop circuit of said progressive voltage generator.

2. Apparatus according to claim 1, including a second presence detector for detecting molten metal in said control pipeline at the level of the inlet to said chamber.

3. Apparatus according to claim 2, wherein said second presence detector is connected to said starting circuit of said progressive voltage generator.

4. Apparatus according to claim 1, wherein said control pipeline terminates, at its upper part, in a chamber provided with an overflow channel for returning metal to said container.

5. Apparatus according to claim 1, wherein said control pipeline is made of a refractory material and is provided with a heating circuit embedded in the walls thereof.

6. Apparatus according to claim 1, wherein said chamber is provided by an injection cylinder of a high pressure casting machine.

7. Apparatus according to claim 1, wherein said chamber is provided by a dispensing chamber of a low pressure casting machine.

* * * * *